United States Patent [19]

Cook

[11] Patent Number: 4,880,230

[45] Date of Patent: Nov. 14, 1989

[54] PNEUMATIC EXERCISE DEVICE

[76] Inventor: Gerry Cook, 1708 Park View Pl., Bozeman, Mont. 59715

[21] Appl. No.: 212,429

[22] Filed: Jun. 28, 1988

[51] Int. Cl.[4] ..... A63B 21/00

[52] U.S. Cl. ..... 272/130

[58] Field of Search ..... 272/96, 126, 130, 134, 272/143, DIG. 4

[56] References Cited

U.S. PATENT DOCUMENTS

| | | | |
|---|---|---|---|
| 3,942,790 | 3/1976 | Rice | 272/126 X |
| 4,063,726 | 12/1977 | Wilson | 272/130 |
| 4,149,713 | 4/1979 | McLeod | 272/130 X |
| 4,226,415 | 10/1980 | Wright | 272/130 |
| 4,452,447 | 6/1980 | Lepley et al. | 272/130 X |
| 4,550,908 | 11/1985 | Dixon | 272/130 |
| 4,667,955 | 5/1987 | Giesch | 272/134 X |

FOREIGN PATENT DOCUMENTS

| | | | |
|---|---|---|---|
| 790469 | 7/1968 | Canada | 272/130 |
| 8101520 | 6/1981 | Int'l Pat. Institute | 272/130 |

*Primary Examiner*—Richard J. Apley
*Assistant Examiner*—Robert W. Bahr
*Attorney, Agent, or Firm*—Richard C. Conover

[57] ABSTRACT

A closed system pneumatic exerciser which includes a double acting pneumatic cylinder in which an external line pneumatically connects chambers formed within the pneumatic cylinder on either side of an enclosed piston. The exerciser is portable and includes structure for removably mounting the cylinder to a wall, for example. A handle or other exerciser engaging device is attached to a shaft connected to the piston to enable a user to push and pull the piston against air pressure developed in a corresponding chamber. Two adjustable valves are mounted in the external line, each of which valves restrict the rate of flow of air in the external line in one direction but does not restrict air flow in the opposite direction. The two valves are positioned back-to-back so that air flow in the external line may be restricted in each direction. A pressure gauge is positioned intermediate these two valves to indicate the pressure in the external line.

5 Claims, 1 Drawing Sheet

PNEUMATIC EXERCISE DEVICE

BACKGROUND OF THE INVENTION

This invention relates to a pneumatic exerciser having a double-acting pneumatic cylinder which can be adjusted to provide a selected resistance in either the tension or compression mode of operation.

Various types of exercise equipment have been developed for muscle building and toning, whether ultimately used as a sport or for physical therapy. One of the more common types of exercise equipment is the weight type device which uses weights to provide the necessary resistance. As is well known, these weight type devices have several disadvantages. They are cumbersome to move since they are generally associated with a frame and bench assembly and the weights need to be moved when the equipment is moved. In addition, these devices may cause injury to an inexperienced user since the weights may be dropped suddenly. Further, when weights are lifted an inertia of movement is created which tends to provide unevenness in the operating resistance during the exercising process.

To overcome these deficiencies various hydraulic systems have been developed such as described in U.S. Pat. No. 4,444,390 to Erichson; U.S. Pat. No. 4,629,185 to Amann; U.S. Pat. No. 4,465,274 to Davenport; and U.S. Pat. No. 4,429,871 to Fleschner. Most of these hydraulic devices use a frame or bench assembly to which the apparatus is mounted, and as a result thereof, this equipment is also not easily transportable. Further, these devices have the disadvantage of requiring somewhat complicated setup procedures before a person can exercise a particular muscle group. This is a problem for physical therapists who want to have equipment which is easily transportable from the office to a patient's home and which equipment can be easily used by the patient without the necessity of providing expensive accessory equipment.

Portable hydraulic exercisers are known. For example, see U.S. Pat. No. 3,834,696 to Spector. This device includes two telescoping tubes which have handles attached to the ends thereof. However, with the general type of device described in this patent, the user must grasp the two handles and either push the two handles together or pull the two handles apart. Thus, this device has limited utility in exercising other muscle groups.

Further, pneumatic systems have also been developed to overcome the disadvantages of weight type systems and the disadvantages of the hydraulic systems. A hydraulic system is a "hard" system since fluid is not compressible. On the other hand, a pneumatic system is a much "softer" system since air is compressible to a certain degree. Examples of pneumatic exercise equipment would include U.S. Pat. No. 4,257,593 to Kelser (utilizing a source of compressed air to provide resistance) and U.S. Pat. No. 3,471,145 to Berger.

In the known hydraulic and pneumatic devices, there are none which show closed systems which permit control of the resistance to be encountered during the compression stroke and the tension stroke independently of one another. Further, none disclose a gauge for determining the amount of resistance being encountered when muscular force is exerted during both the compression or tension stroke.

U.S. Pat. No. 4,465,274 to Davenport does describe a double acting hydraulic cylinder where hydraulic fluid is directed through an external line from a chamber on one side of the internal hydraulic piston to a chamber on the other side of this piston. An adjustable valve is provided in this external line to provide restricted flow in both directions at the same time. This valve does not permit independent control of the resistance in the compression stroke and the tension stroke. A pressure gauge is used to indicate the hydraulic pressure within the line during fluid flow in one direction but not both directions. This exerciser is used by exerting muscular force on the piston and moving the piston against the hydraulic pressure developed by forcing fluid through the valved external line.

U.S. Pat. No. 3,471,145 to Berger describes a telescoping tube pneumatic exerciser. Here the end wall of one of the telescoping tubes acts as a pneumatic piston. In this device, the flow of air between the two tubes may be adjustably restricted by flap valves located on the piston element of this device. This patent describes structure for selecting the resistance to be encountered in either the compression or the tension mode but not both. This patent also describes a portable exerciser but again uses handles which are mounted at each end of the exerciser. The handles are grasped and are either pulled toward one another or pulled apart.

In view of the exercise apparatus now known, there is a need for a device where a user can adjust the tension resistance and compression resistance independently of one another. There is a need for a device which is transportable and which can be set up in a person's home easily without requiring a complicated bench and frame assembly. Further, there is a need for a device which is versatile in being able to exercise many muscle groups without having to go through extended setup procedures.

SUMMARY OF INVENTION

The present invention relates to a pneumatic exerciser in which the resistance offered in the compression stroke and tension stroke can be independently adjusted. In addition, the exerciser, according to the present invention, is portable and can be used to exercise a variety of muscle groups. The device is compact and simple to manufacture and to operate. It can be used vertically or horizontally or at any angle in between. It is a safe device and overcomes many of the disadvantages of weight type systems and hydraulic systems.

The present invention includes a double acting pneumatic cylinder in which an external line pneumatically connects the chambers formed within the pneumatic cylinder on either side of the piston. The cylinder is removably attached to a wall, for example, with a mounting device. In the present invention, this mounting device is preferably a suction element. A handle or other exerciser engaging device for enabling a user to use the system is attached to the shaft connected to the piston enclosed in the pneumatic cylinder. As the piston is moved back and forth within the pneumatic cylinder, pressure is developed in one of the chambers within the cylinder. Air is forced through the external line from one chamber to the other chamber during each stroke.

In the present invention, there are two adjustable valves mounted in the external line which restrict the rate of air flow through the external line as it passes from one chamber to the other. Each of these two valves restrict air flow in one direction but present no restriction in the opposite direction. The two valves are positioned back-to-back so that air flow in each direction may be restricted. A pressure gauge is positioned intermediate these two valves to indicate the pressure in the external line when the user makes either a compression stroke or a tension stroke.

By using valves in the external line, sturdier, more reliable, and more serviceable valves can be used than has been the case with valves that have been located adjacent the piston element within the pneumatic cylinder. Further, by having two valves and the pressure gauge located between the valves, one gauge can be used to indicate pressure in both directions. This unique arrangement provides a very simple exerciser which is highly transportable and allows adjustment of the resistance to be provided in both the tension and compression strokes.

BRIEF DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF A PREFERRED EMBODIMENT

Figure 1:
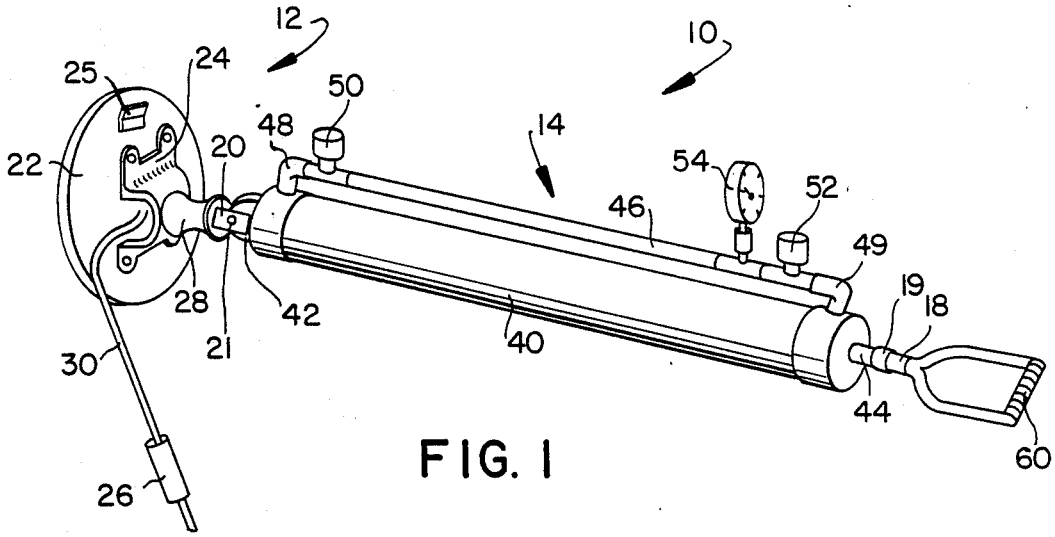
FIG. 1 is a perspective view of a preferred embodiment of the present invention.
Figure 2:
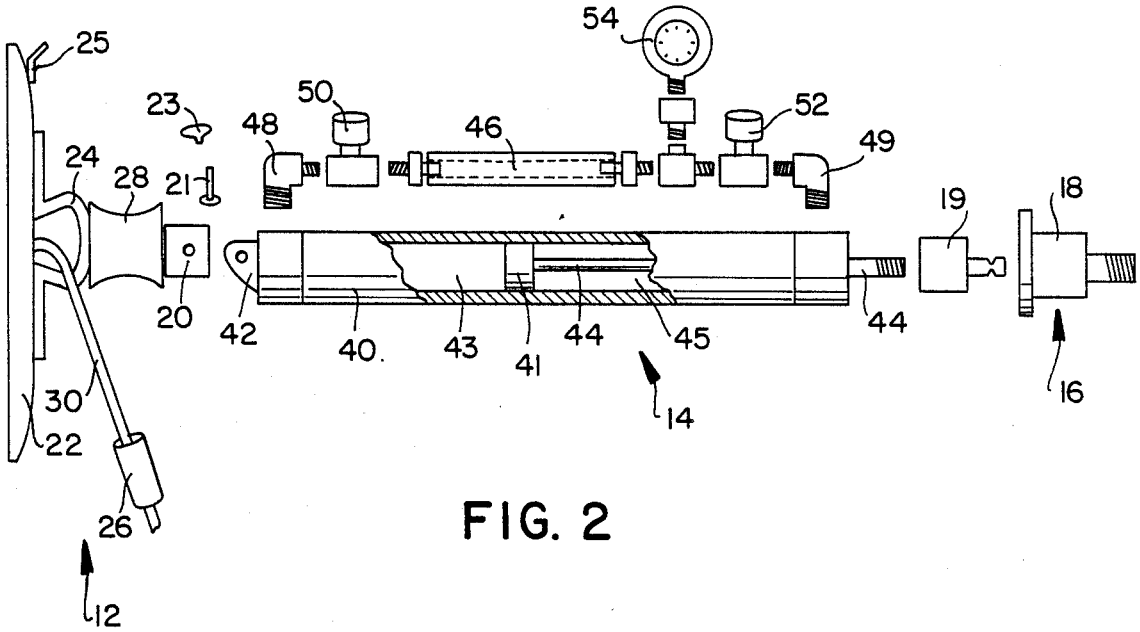
FIG. 2 is an exploded view of the double-acting pneumatic cylinder shown in FIG. 1.

Referring now to the drawings, FIG. 1 shows a pneumatic exerciser 10 according to the present invention. This exerciser includes a double-acting pneumatic cylinder 14, a mounting device 12 for mounting the cylinder 14 to a surface such as a wall and, further, an exerciser engaging device such as a handle 60 which is connected to the double-acting cylinder 14 as will be described below.

In a preferred embodiment, the mounting device 12 is a vacuum suction disk, Model JT156-RH Power-Grip, manufactured by Woods Power-Grip Co., Inc., although any other suitable device may be used. The preferred mounting device 12 includes a flexible disk 22 that can be placed on a smooth, flat or curved surface. A hand suction pump 26 evacuates air through tube 30 thereby placing a suction between the surface and the gripping disk 22. Suction holds the gripper tightly against the surface. The suction can be readily released by pulling on tab 25 so that the exercise device can be removed from the surface easily without causing damage to the surface to which the device is attached.

The mounting device 12 includes a bracket assembly 24 to which is mounted a flexible intermediate connecting member 28, preferably formed of a rubber material, for connecting to clevis 20. The intermediate connecting member 28 being flexible allows pivotal movement of the clevis 20 about a point where the intermediate connecting member 28 is connected to bracket assembly 24. The clevis 20 is connected to connecting member 42 with a clevis pin 21. The connecting member 42 is integrally formed on an end wall of cylinder portion 40 of the double-acting pneumatic cylinder assembly 14.

The double-acting pneumatic cylinder assembly 14 includes the outer hollow cylinder 40 which slidably encloses a piston 41. Internal chambers 43 and 45 within the cylinder 40 are formed on either side of piston 41. Cylinder assembly 14 is a closed system wherein chamber 43 is in pneumatic communication with chamber 45 through external line 46.

The external line 46 is connected to cylinder 40 with fitting 48 and extends through the cylinder wall so that line 46 is in pneumatic communication with chamber 43. The other end of line 46 extends through the cylinder wall to chamber 45 through fitting 49.

Two control valves 50 and 52 are used to control the flow of air through the line 46 in either direction. The valves 50 and 52 permit flow in only one direction and unrestricted flow in the other direction. These two flow control valves are mounted back-to-back so that there is one valve restricting flow in each direction. A pressure gauge 54 is mounted in the line 46 between the two control valves 50 and 52. As can be seen with this arrangement, the pressure gauge 54 indicates pressure in line 46 regardless of the direction of air flow in line 46.

A shaft 44 is attached to the piston 41 on the side of the piston opposite where the pneumatic cylinder 14 is connected to the mounting device 12. This shaft 44 extends through the end wall of the cylinder 40. An appropriate seal is provided in the end wall to prohibit air from escaping around the shaft 44.

A quick coupler male fitting 19 is mounted to the end of shaft 44. A quick coupler female fitting 18 is releasably mounted to the male coupler 19. As shown in FIG. 1, a handle 60 is attached to the female coupler 18 and together they can be releasably secured to the shaft 44. With this arrangement, the user's hand grasps the handle 60 and either pushes or pulls piston 41 in the pneumatic cylinder 14. The amount of resistance in either direction can be selected with the corresponding valves 50 and 52. The pressure in line 46 is indicated by gauge 54.

Figure 3:
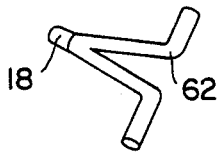
FIG. 3 shows an alternative attachment for use with the invention shown in FIG. 1.

FIG. 3 shows an alternative handle 62. This particular handle is commonly known as a "handlebar". Again this handlebar 62 is attached to a female quick coupler fitting 18. With this arrangement, the handlebar 62 can be easily secured to the exerciser 10 with corresponding male coupler 19.

Figure 4:
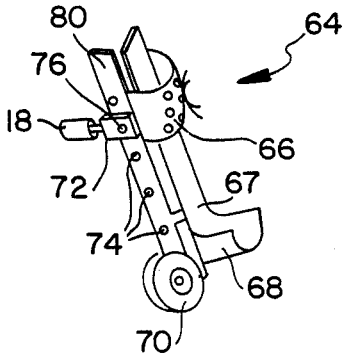
FIG. 4 shows a further alternative attachment for use with the invention shown in FIG. 1.

FIG. 4 shows yet another attachment which can be used with this exerciser 10. This is a foot attachment 64. The foot attachment 64 includes a toe strap 66 for holding a user's foot to a sole plate 67. A heel brace 68 is provided for supporting the user's heel. Roller wheels 70 are used to rollably support the foot during push and pull movements of the leg. An adjustment bar 80 mounted to the underside of sole plate 67 is provided with holes 74, a single one of which can be selectively attached to clevis 72 with clevis pin 76. This adjustment bar 80 allows a user to select the point at which force is transmitted to the sole plate 67 from the exerciser. The clevis 72 is attached to a female quick coupler 18 as previously described. With this attachment, a user can move a foot back and forth against the resistance offered by exerciser 10.

In operation, a body builder or physical therapist can position the mounting device 12 against a smooth, immoveable surface such as a wall. The double-acting pneumatic cylinder assembly 14 is connected to the mounting device 12 by inserting clevis pin 21 through clevis 20 and the connecting member 42. Next an attachment can be selected, such as handle 60, which is connected to the male quick coupler fitting 19. Flow control valves 50 and 52 can be set to provide the desired resistance in either direction. The body builder then moves the piston 41 within the pneumatic cylinder 40 in either direction and pressure gauge 54 indicates the pressure in line 46.

With the present invention, a highly portable and simple device is provided which can be used to exercise various muscle groups of the human body. The device is safe, clean and can be used in most positions including a vertical or a horizontal position or some other angle in between. The present invention allows the user to easily control the resistance to be encountered in either the compression or tension mode of operation.

While the fundamental novel features of the invention have been shown and described, it should be understood that various substitutions, modifications and variations may be made by those skilled in the art without departing from the spirit or scope of the invention. Accordingly, all such modifications or variations are included in the scope of the invention as defined by the following claims.

I claim:

1. A portable, stand-alone, pneumatic exercise device comprising:

a closed double-acting pneumatic cylinder having first and second ends, the cylinder enclosing a moveable piston element;

a first and second operating chambers positioned within the cylinder on opposite sides of the piston element;

a suction cup for mounting the exercise device to a surface external to the exercise device;

a pivotal connection means for pivotally connecting the suction cup and the pneumatic cylinder;

a shaft connected to the piston and extending through a sealed end wall on the second end of the double-acting pneumatic cylinder;

a pneumatic line located outside the double-acting pneumatic cylinder and interconnecting the first chamber and the second chamber to allow air to flow between the first and second chambers;

a first valve means for adjusting the rate of flow in the pneumatic line in one direction;

a second valve means for selectably adjusting the rate of flow in the pneumatic line in the opposite direction;

a gauge means located between the two valve means to indicate pressure in the line; and a quick coupling fitting connected to the end of the shaft opposite the piston;

an exerciser engaging means for connecting to the quick coupling fitting to enable a user to push and pull the piston as well as move the second end of the cylinder pivotally with respect to the suction cup whereby a user can exercise selected muscle groups.

2. An exerciser according to claim 1 wherein the pivotal connection means further includes:

a bracket assembly securely mounted on the suction cup;

a flexible intermediated connecting member made of a resilient material and securely mounted at one end thereof to the bracket assembly; and a swivel connecting the flexible intermediate connecting member to the pneumatic cylinder so that the swivel and the intermediate connecting member permit the cylinder to pivot about a point where the intermediate connecting member is connected to the bracket assembly.

3. An exerciser as set forth in claim 1 wherein the exerciser engaging means includes a handle to be grasped by the hand of the user.

4. An exerciser according to claim 1 wherein the exerciser engaging means includes means for releasably securing a user's foot to the shaft.

5. An exerciser according to claim 4 wherein the exerciser engaging means further comprises:

a sole plate to support the foot;

a toe strap connected to the sole plate to hold the foot against the sole plate;

a heel brace attached to the sole plate to support the heel of the foot;

means connected to the sole plate for allowing the user to adjust the point at which force is transmitted between the sole plate and the exerciser; and a roller attached below the sole plate to permit the roller to roll over a ground plane surface when a user is using the exerciser.

* * * * *